US010043538B2

(12) United States Patent
Tootill et al.

(10) Patent No.: US 10,043,538 B2
(45) **Date of Patent: *Aug. 7, 2018**

(54) ANALYZING CHANGES IN VOCAL POWER WITHIN MUSIC CONTENT USING FREQUENCY SPECTRUMS

(71) Applicant: Microsoft Technology Licensing, LLC, Redmond, WA (US)

(72) Inventors: Stewart Paul Tootill, Bracknell (GB); Kevin Lingley, Saffron Walden (GB); David Niall Coghlan, London (GB); Michal Vine, Fleet (GB); Linden Vongsathorn, Godalming (GB)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/814,292

(22) Filed: Nov. 15, 2017

(65) Prior Publication Data

US 2018/0075866 A1 Mar. 15, 2018

Related U.S. Application Data

(63) Continuation of application No. 15/331,651, filed on Oct. 21, 2016, now Pat. No. 9,852,745.

(Continued)

(51) Int. Cl.

*G10L 25/18* (2013.01)
*G10L 21/0308* (2013.01)

(Continued)

(52) U.S. Cl.

CPC ..... *G10L 25/18* (2013.01); *G10L 21/0308* (2013.01); *G10L 25/27* (2013.01); *G10L 25/51* (2013.01)

(58) Field of Classification Search

CPC ..... G10L 25/27; G10L 25/51; G10L 25/18; G10L 21/0308

See application file for complete search history.

(56) References Cited

U.S. PATENT DOCUMENTS 6,945,784 B2 9/2005 Paquette et al.
2006/0065102 A1 3/2006 Xu (Continued)

FOREIGN PATENT DOCUMENTS

CN 101635160 1/2010
CN 104616663 5/2015

OTHER PUBLICATIONS

Jeong, et al., "Vocal Separation from Monaural Music Using Temporal/Spectral Continuity and Sparsity Constraints", In Journal of IEEE Signal Processing Letters, vol. 21, Issue 10, Oct. 2014, pp. 1197-1200.

(Continued)

*Primary Examiner* — Brenda C Bernardi
(74) *Attorney, Agent, or Firm* — Klarquist Sparkman, LLP

(57) ABSTRACT

Technologies are described for identifying familiar or interesting parts of music content by analyzing changes in vocal power using frequency spectrums. For example, a frequency spectrum can be generated from digitized audio. Using the frequency spectrum, the harmonic content and percussive content can be separated. The vocal content can then be separated from the harmonic and/or percussive content. The vocal content can then be processed to identify surge points in the digitized audio. In some implementations, the vocal content is included in the harmonic content during the separation procedure and is then separated from the harmonic content.

20 Claims, 9 Drawing Sheets

Related U.S. Application Data

(60) Provisional application No. 62/354,594, filed on Jun. 24, 2016.

(51) Int. Cl.
*G10L 25/51* (2013.01)
*G10L 25/27* (2013.01)

(56) References Cited

U.S. PATENT DOCUMENTS

| | | | |
|---|---|---|---|
| 2014/0338515 | A1 | 11/2014 | Sheffer et al. |
| 2015/0016614 | A1 | 1/2015 | Buyens |
| 2016/0155456 | A1 | 6/2016 | Wang |

OTHER PUBLICATIONS

Deif, et al., "Separation of Vocals from Monaural Music Recordings Using Diagonal Median Filters and Practical Time-Frequency Parameters", In Proceedings of IEEE International Symposium on Signal Processing and Information Technology, Dec. 7, 2015, pp. 163-167.

Rump, et al., "Autoregressive MFCC models for genre classification improved by harmonic-percussion separation", In Proceedings of 11th International Society for Music Information Retrieval Conference, Aug. 9, 2010, pp. 87-92.

Li, et al., "Separation of Singing Voice from Music Accompaniment for Monaural Recordings", In Proceedings of IEEE Transactions on Audio, Speech, and Language Processing, vol. 15, No. 4, May 2007, pp. 1475-1487.

Xu, et al., "Source Separation Improves Music Emotion Recognition", In Proceedings of International Conference on Multimedia Retrieval, Apr. 1, 2014, 4 pages.

Xu, et al., "Automatic music classification and summarization", In Journal of IEEE Transactions on Speech and Audio Processing, vol. 13, Issue 3 , May 2005, pp. 441-450.

Maddage, et al., "Content-based music structure analysis with applications to music semantics understanding", In Proceedings of the 12th annual ACM international conference on Multimedia, Oct. 10, 2004, pp. 112-119.

Bello, et al., "A Tutorial on Onset Detection in Music Signals", In Journal of IEEE Transactions on Speech and Audio Processing, vol. 13, Issue 5, Sep. 2005, pp. 1-13.

Chen, et al., "Analysis of Music Representations of Vocal Performance Based on Spectrogram", In Proceedings of 6th International Conference on Wireless Communications Networking and Mobile Computing, Sep. 23, 2010, 4 pages.

Tachibana, "Singing Voice Enhancement in Monoaural Music Signals Based on Two-stage Harmonic/Percussive Sound Separation on Multiple Resolution Spectrograms," IEEE/ACM Transactions on Audio, Speech, and Language Processing, vol. 22, No. 1, Jan. 2014, pp. 228-237.

400

ANALYZING CHANGES IN VOCAL POWER WITHIN MUSIC CONTENT USING FREQUENCY SPECTRUMS

CROSS REFERENCE TO RELATED APPLICATIONS

This is a continuation of U.S. patent application Ser. No. 15/331,651, filed Oct. 21, 2016, which claims the benefit of U.S. Provisional Patent Application No. 62/354,594, filed Jun. 24, 2016, which are incorporated by reference herein.

BACKGROUND

It is difficult for a computer-implemented process to identify the part of a song that a listener would find interesting. For example, a computer process may receive a waveform of a song. However, the computer process may not be able to identify which part of the song a listener would find interesting or memorable.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Technologies are provided for identifying surge points within audio music content (e.g., indicating familiar or interesting parts of the music) by analyzing changes in vocal power using frequency spectrums. For example, a frequency spectrum can be generated from digitized audio. Using the frequency spectrum, the harmonic content and percussive content can be separated. The vocal content can then be separated from the harmonic and/or percussive content. The vocal content can then be processed to identify surge points in the digitized audio. In some implementations, the vocal content is included in the harmonic content during the separation procedure and is then separated from the harmonic content Technologies are described for identifying familiar or interesting parts of music content by analyzing changes in vocal power.

DETAILED DESCRIPTION

Overview

As described herein, various technologies are provided for identifying familiar or interesting parts of music content by analyzing changes in vocal power using frequency spectrums. For example, a frequency spectrum can be generated from digitized audio. Using the frequency spectrum, the harmonic content and percussive content can be separated. The vocal content can then be separated from the harmonic and/or percussive content. The vocal content can then be processed to identify surge points in the digitized audio. In some implementations, the vocal content is included in the harmonic content during the separation procedure and is then separated from the harmonic content.

In some solutions, music segmentation techniques are used to try and identify interesting parts of a song. Much of the existing work uses techniques such as Complex Non-Negative Matrix Factorization or Spectral Clustering which are undirected machine learning techniques used to find structure in arbitrary data, or the Foote novelty metric to find places in a recording where the musical structure changes. While these techniques were initially promising and were used for a prototype, they had a number of drawbacks. The first is that they are extremely computationally intensive, taking several times the duration of a track to perform the analysis. Second, these techniques all suffered from various issues where the structure in the track was not obvious from the dataset used. For example, the song "Backseat" by Carina Round has very obvious musical segments to the listener, however the musical structure of the track does not actually change very much at all. The final and most significant problem is that while these techniques will allow the process to find musical structure in a track, they do not assist with the core part of the problem which is determining which part is most interesting. As a result, additional technologies needed to be developed to determine which segment was interesting.

Figure 4:
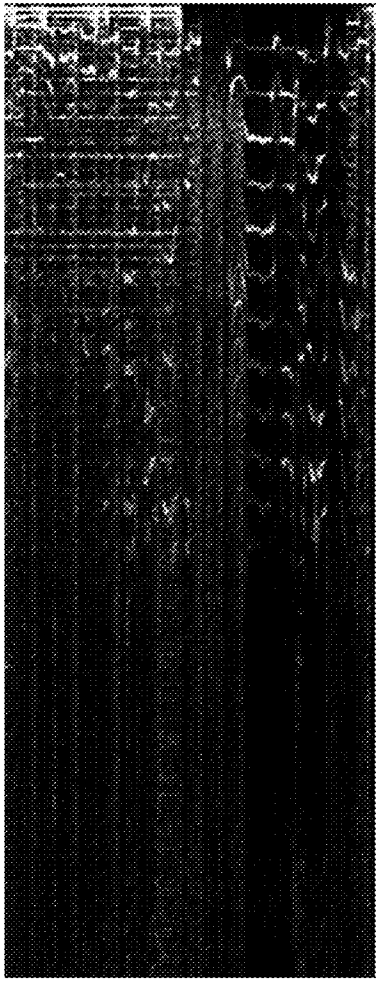
FIG. 4 is a diagram depicting an example spectrogram generated from example music content.

As a result of the limitations of the initial approaches, a new solution was devised. First, a heuristic method was selected for finding the "hook" of a song which would work for much of the content that was being analyzed. This heuristic method was the point in the song where the singer starts to sing louder than they were before. As an example, at about 2:43 in Shake It Off by Taylor Swift there is a loud note sung as the song enters the chorus. This was a common enough pattern to be worth exploring. The first problem in implementing this was to devise a way to separate the vocal content from the rest of the track. To do this a technique for separating harmonic and percussive content in a track was extended. This works by analyzing the frequency spectrum of the track. The image in FIG. 4 shows the unprocessed spectrogram 400 of the start of the hook from Shake It Off (time is increasing from top to bottom, frequency is increasing from left to right). There are several characteristics which are visible in the spectrogram 400. The key one is that there are lines which are broadly horizontal in the image—these represent "percussive" noises such as drums which are characterized as short bursts of wide band noise—and there are lines which are broadly vertical which represent "harmonic" noises such as those generated by string instruments or synthesizers which generate tones and their harmonics that are sustained over time. By using this characteristic, median filtering can be used on the spectrogram to separate the vertical lines from the horizontal lines and generate two separate tracks containing separate harmonic and percussive content. While the separation is not perfect from a listener point of view, it works well for analysis as the other features that bleed through are sufficiently attenuated. Since vocal content does not precisely follow either of these patterns (it can be seen in the image above as the wiggly lines in the dark horizontal band where there is only singing), it was discovered that it gets assigned to either the percussive or harmonic component dependent on the frequency resolution used to do the processing (e.g., corresponding to the number of frequency bands used to generate the spectrogram). By exploiting this and running two passes at different frequency resolutions a third track can be generated containing mostly vocal content.

Figure 5:
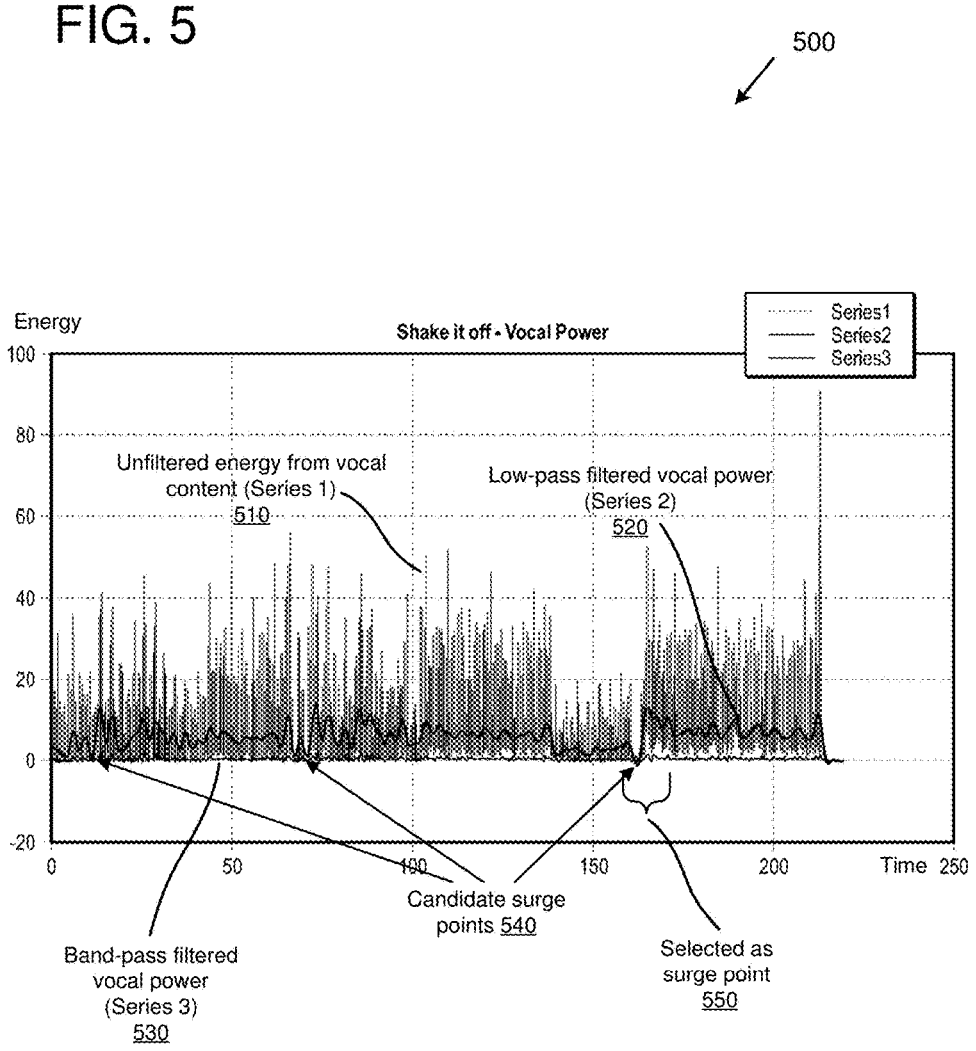
FIG. 5 is a diagram depicting an example graph depicting vocal power generated from the example spectrogram.

From these separated tracks the vocal power at various points in the track can be determined. FIG. 5 shows the vocal power determined from the example spectrogram depicted in FIG. 4. As depicted in the graph 500, the series 1 data (unfiltered energy from the vocal content 510, depicted as the narrow vertical columns in the graph) shows the raw unprocessed power of the vocal content. While this is useful data, it is difficult to work with because it contains a lot of "noise"—for example the narrow spikes are really representing the timbre of Taylor Swift's voice which may not be particularly interesting. In order to make it more useful, a number of filters can be applied to generate more useful signals. The series 2 line (low-pass filtered vocal power 520) represents the same data with a low-pass filter applied to remove features that are less than the length of a single bar. The series 3 line (band-pass filtered vocal power 530, which runs close to the 0 energy horizontal axis) is generated using a band pass filter to show features which are in the range of 1 beat to 1 bar long. The start of the hook can quite clearly be seen in the graph 500 as the sharp dip in the low-pass filtered vocal power line 520 at 164 seconds (along the horizontal axis). In order to locate this point, in some implementations the procedure looks for minima in the low-pass filtered vocal power 520 line (which are identified as candidates) and then examines the audio following the minima to generate classifiers. As an example, three local minimums are identified in the graph 500 as candidate surge points 540. In some implementations, the classifiers include the total amount of audio power following the minima, the total amount of vocal power, and how deep the minima are. These classifiers are fed into a ranking algorithm to select one of the candidates as the surge point (e.g., the highest ranked candidate is selected). As depicted in the graph 500, the three candidate surge points 540 have been analyzed and one surge point 550 has been selected. From the graph 500, it is fairly clear why surge point 550 was selected from the candidates (e.g., was ranked highest using the classifiers) as it has the lowest local minimum and the vocal power after the minimum is significantly higher than before the minimum.

Example Environments for Identifying Surge Points within Music Content

In the technologies described herein, environments can be provided for identifying surge points within music content. A surge point can be identified from the vocal power of the music content and can indicate an interesting and/or recognizable point within the music content. For example, a surge point can occur when the vocal content becomes quiet and then loud relative to other portions of the content (e.g., when a singer takes a breath and then sings loudly).

For example, a computing device (e.g., a server, laptop, desktop, tablet, or another type of computing device) can perform operations for identifying surge points within music content using software and/or hardware resources. For example, a surge point identifier (implemented in software and/or hardware) can perform the operations, including receiving digital audio content, identifying surge points in the digital audio content using various processing operations (e.g., generating frequency spectrums, performing median filtering, generating classifier data, etc.), and outputting results.

Figure 1:
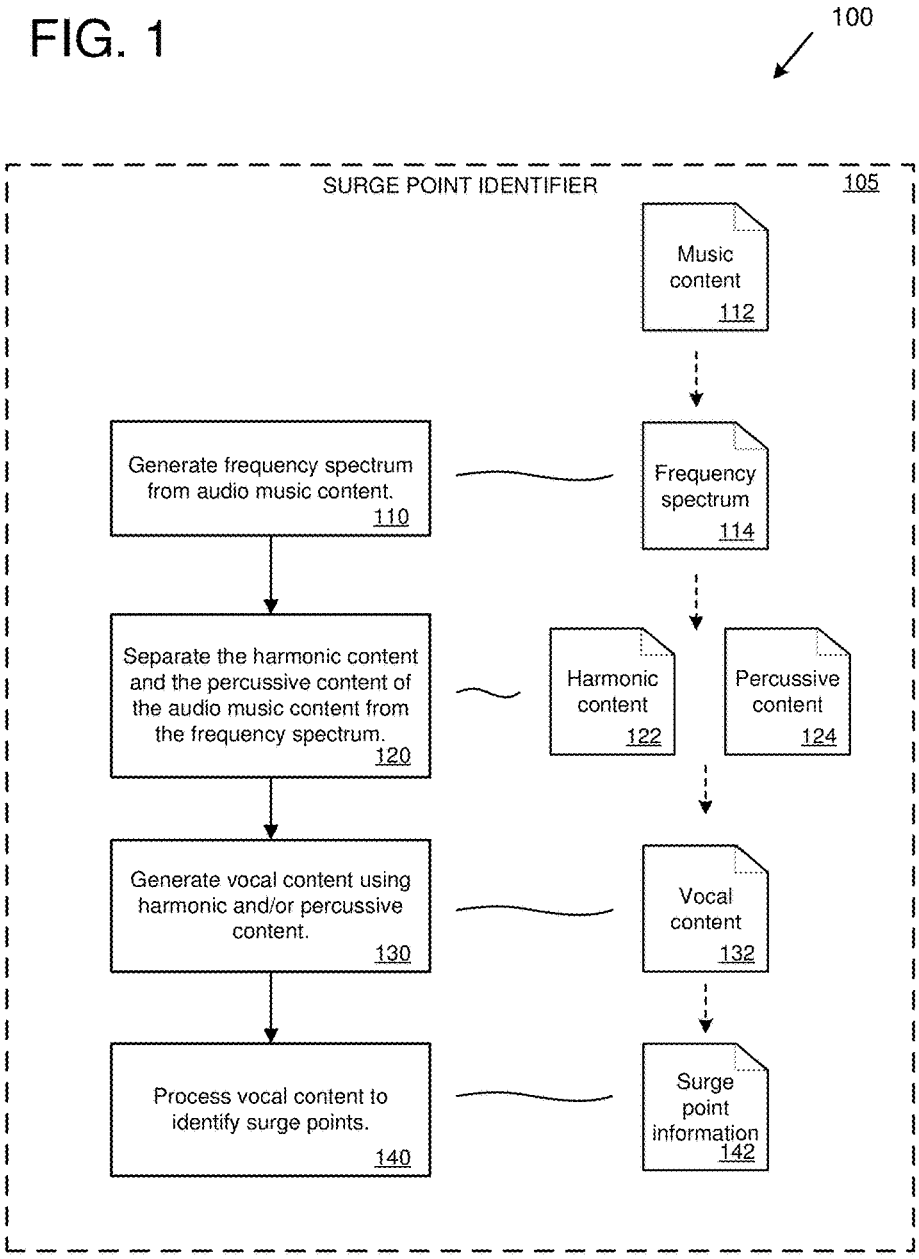
FIG. 1 is a diagram depicting an example environment for identifying surge points by separating harmonic content and percussive content.

FIG. 1 is a diagram depicting an example environment 100 for identifying surge points by separating harmonic content and percussive content. For example, the environment 100 can include a computing device implementing a surge point identifier 105 via software and/or hardware.

As depicted in the environment 100, a number of operations are performed to identify surge points in music content. The operations begin at 110 where a frequency spectrum (e.g., a spectrogram) is generated from at least a portion of the audio music content 112. For example, the music content can be a song or another type of music content. In some implementations, the frequency spectrum is generated by applying a short-time Fourier transform (STFT) to the audio music content 112. In some implementations, the frequency spectrum is generated by applying a constant-Q transform to the audio music content 112.

The audio music content 112 is a digital representation of music audio (e.g., a song or other type of music). The audio music content 112 can be obtained locally (e.g., from a storage repository of the computing device) or remotely (e.g., received from another computing device). The audio music content 112 can be stored in a file of a computing device, stored in memory, or stored in another type of data repository.

At 120, the harmonic content 122 and the percussive content 124 of the audio music content are separated from the frequency spectrum. In some implementations, median filtering is used to perform the separation. The harmonic content 122 and the percussive content 124 can be stored as separate files, as data in memory, or stored in another type of data repository.

At 130, the vocal content 132 is generated from the harmonic content 122 and/or from the percussive content 124. For example, depending on how the separation is performed at 120, the vocal content may be primarily present in either the harmonic content 122 or the percussive content 124 (e.g., dependent on a frequency resolution used to perform the STFT). In some implementations, the vocal content is primarily present within the harmonic content 122. The vocal content 132 can be stored as a separate file, as data in memory, or stored in another type of data repository.

For example, in some implementations obtaining the separate vocal content involves a two-pass procedure. In a first pass, the frequency spectrum 114 is generated (using the operation depicted at 110) using an STFT with a relatively low frequency resolution. Median filtering is then performed (e.g., part of the separation operation depicted at 120) to separate the harmonic and percussive content where the vocal content is primarily included in the harmonic content due to the relatively low frequency resolution. In a second pass, the harmonic (plus vocal) content is processed using an STFT (e.g., part of the operation depicted at 130) with a relatively high frequency resolution (compared with the resolution used in the first pass), and median filtering is then performed (e.g., as part of the operation depicted at 130) on the resulting frequency spectrum to separate the vocal content from the harmonic (plus vocal) content.

At 140, the vocal content 132 is processed to identify surge points. In some implementations, a surge point is the location within the music content where vocal power falls to a minima and then returns to a level higher than the vocal power was prior to the minima. In some implementations, various classifiers are considered in order to identify the surge point (or surge points), which can include various features of vocal power, and can also include features related to spectral flux, and/or Foote novelty. Surge point information 142 can be output (e.g., saved to a file, displayed, sent via a message, etc.) indicating one or more surge points (e.g., via time location). The surge point information 142 can also include portions of the music content 112 (e.g., a number of seconds around a surge point representing an interesting or recognizable part of the song).

Figure 2:
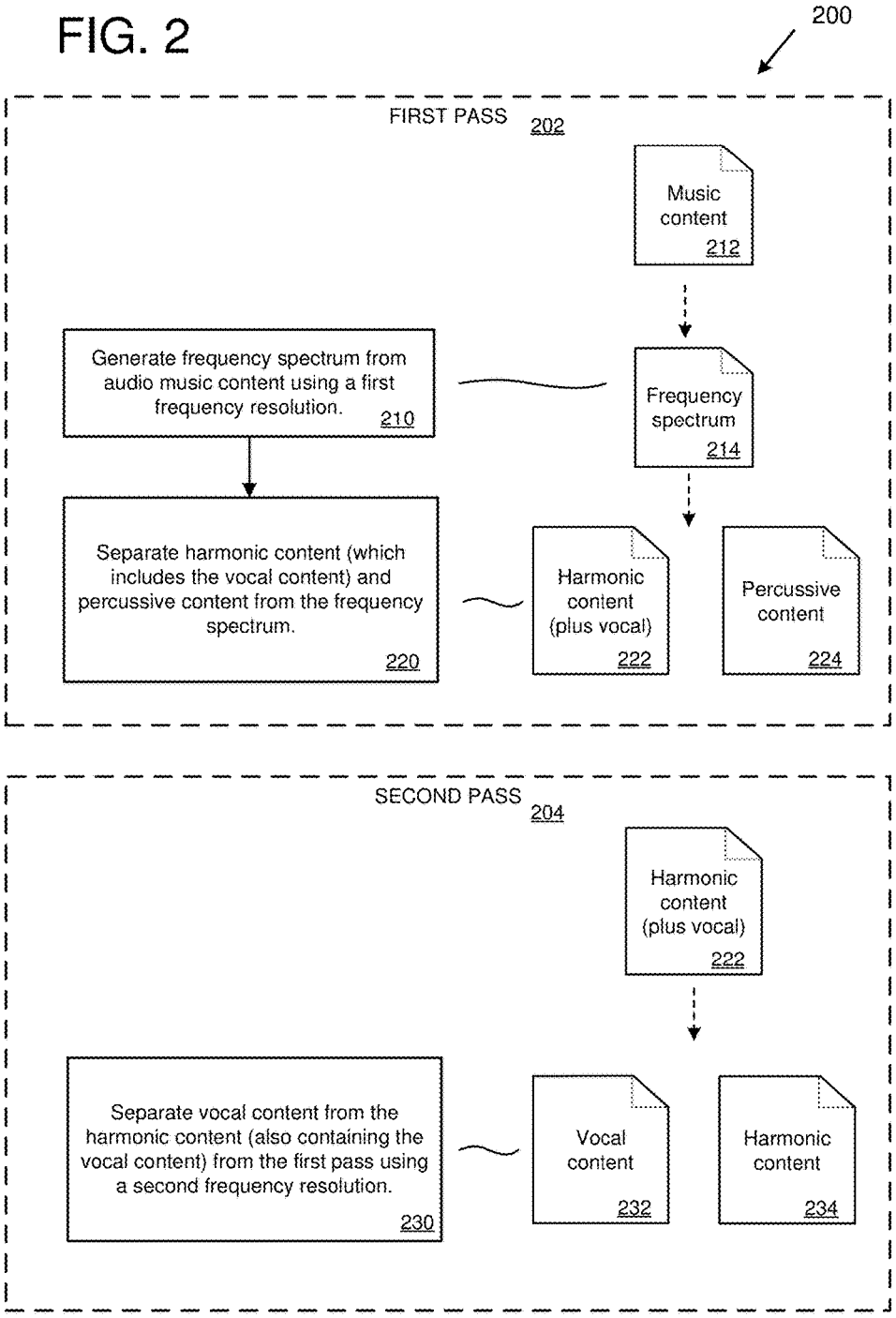
FIG. 2 is a diagram depicting an example procedure for generating vocal content.

FIG. 2 is a diagram depicting an example two-pass procedure 200 for generating vocal content. Specifically, the example procedure 200 represents one way of performing the operations, depicted at 110, 120, and 130, for generating vocal content from separated harmonic content and percussive content. In a first pass 202, a frequency spectrum 214 is generated using an STFT with a first frequency resolution, as depicted at 210. Next, the harmonic content (including the vocal content) 222 and the percussive content 224 are separated (e.g., using median filtering) from the frequency spectrum 214, as depicted at 220. The first frequency resolution is selected so that the vocal content is included in the harmonic content 222.

In a second pass 204, the harmonic content 222 (which also contains the vocal content) is processed using an STFT with a second frequency resolution, as depicted at 230. For example, median filtering can be used to separate the vocal content 232 and harmonic content 234 from the STFT generated using the second frequency resolution. For example, the first STFT (generated at 210) can use a small widow size resulting a relatively low frequency resolution (e.g., 4,096 frequency bands) while the second STFT (generated at 230) can use a large window size resulting in relatively high frequency resolution (e.g., 16,384 frequency bands).

In an example implementation, separating the vocal content is performed using the following procedure. First, as part of a first pass (e.g., first pass 202), an STFT is performed with a small window size (also called a narrow window) on the original music content (e.g., music content 112 or 212) (e.g., previously down converted to single channel) to generate the frequency spectrum (e.g., as a spectrogram), such as frequency spectrum 114 or 214. A small window size is used in order to generate the frequency spectrum with high temporal resolution but poor (relatively speaking) frequency resolution. Therefore, a small window size uses a number of frequency bands that is relatively smaller than with a large window size. This causes features which are localized in time but not in frequency (e.g. percussion) to appear as vertical lines (when drawn with frequency on the y axis and time on the x axis), and non-percussive features to appear as broadly horizontal lines. Next, a median filter with a tall kernel is used to generate a kernel which is fed to a wiener filter in order to separate out features which are vertical. This generates "percussion" content (e.g., percussive content 124 or 224), which is discarded in this example implementation. What is left is the horizontal and diagonal/curved components which are largely composed of the harmonic (instrumental) and vocal content (e.g., harmonic content 122 or 222) of the track which is reconstructed by performing an inverse STFT.

Next, as part of a second pass (e.g., second pass 204), the vocal and harmonic data (e.g., harmonic content 122 or 222) is again passed through an STFT, this time using a larger window size. Using a larger window size (also called a wide window) increases the frequency resolution (compared with the first pass) but at the expense of reduced temporal resolution. Therefore, a large window size uses a number of frequency bands that is relatively larger than with a small window size. This causes some of the features which were simply horizontal lines at low frequency resolution to be resolved more accurately and in the absence of the percussive "noise" start to resolve as vertical and diagonal features. Finally, a median filter with a tall kernel is again used to generate a kernel for a wiener filter to separate out the vertical features which are reconstructed to generate the "vocal" content (e.g., vocal content 132 or 232). What is left is the "harmonic" content (e.g., harmonic content 234) which is largely the instrumental sound energy and for the purposes of this example implementation is discarded.

Figure 3:
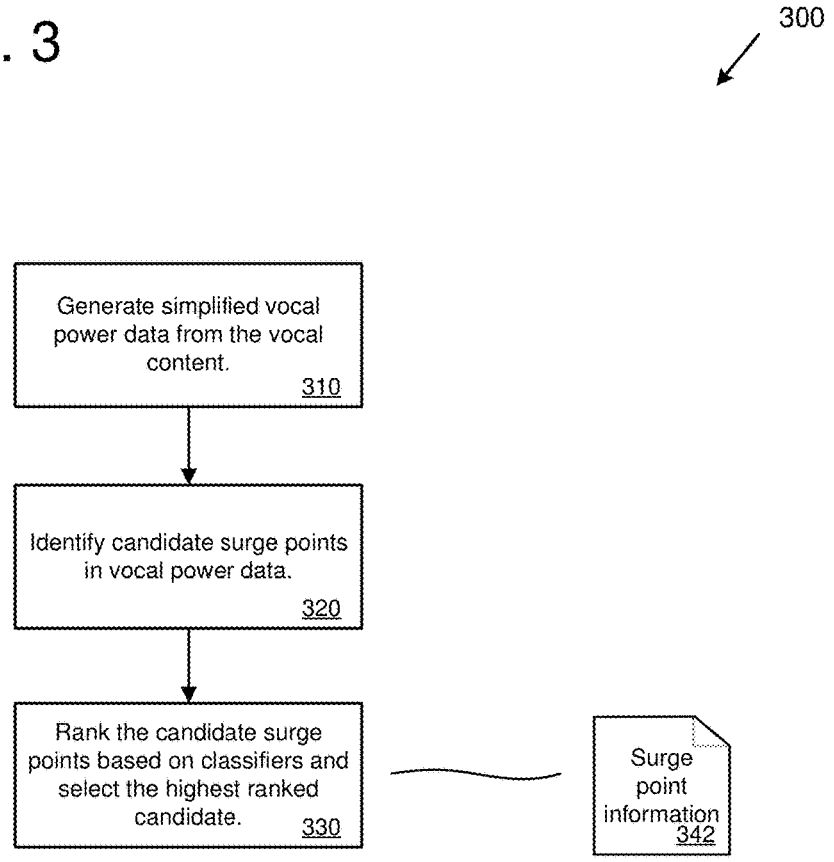
FIG. 3 is a diagram depicting an example procedure for identifying surge points from filtered vocal power data.

FIG. 3 is a diagram depicting an example procedure 300 for identifying surge points from simplified vocal power data. The example procedure 300 represents one way of processing the vocal content to identify the surge point(s), as depicted at 140. At 310, simplified vocal power data is generated from the vocal content (e.g., from vocal content 132) by applying a filter (e.g., a low-pass filter) to the vocal content.

In a specific implementation, generating the filtered (also called simplified) vocal power data at 310 is performed as follows. First, the vocal content (the unfiltered energy from the vocal content) is reduced to 11 ms frames, and then the energy in each frame is computed. The approximate time signature and tempo of the original track is then estimated. A low-pass filter is then applied to remove features that are less than the length of a single bar (also called a measure). This has the effect of removing transient energies. In some implementations, a band-pass filter is also applied to show features which are in the range of one beat to one bar long. This has the effect of removing transient energies (e.g., squeals or shrieks) and reducing the impact of long range changes (e.g., changes in the relative energies of verses) while preserving information about the changing energy over bar durations. The filtered data can be used to detect transitions from a quiet chorus to a loud verse.

At 320, candidate surge points are identified in the vocal power data generated at 310. The candidate surge points are identified as the local minima from the vocal power data. The minima are the points in the vocal power data where the vocal power goes from loud to quiet and is about to become loud again. For example, the candidate surge points can be identified from only the low-pass filtered vocal power or from a combination of filtered data (e.g., from both the low-pass and the band-pass filtered data).

At 330, the candidate surge points identified at 320 are ranked based on classifiers. The highest ranked candidate is then selected as the surge point. The classifiers can include a depth classifier (representing the difference in energy between the minima and its adjacent maxima, indicating how quiet the pause is relative to its surroundings), a width classifier (representing the width of the minima, indicating the length of the pause), a bar energy classifier (representing the total energy in the following bar, indicating how loud the following surge is), and a beat energy classifier (representing the total energy in the following beat, indicating how loud the first note of the following surge is). In some implementations, weightings are applied to the classifiers and a total score is generated for each of the candidate surge points. Information representing the selected surge point is output as surge point information 342.

Example Methods for Identifying Surge Points within Music Content

In the technologies described herein, methods can be provided for identifying surge points within music content. A surge point can be identified from the vocal power of the music content and can indicate an interesting and/or recognizable point within the music content. For example, a surge point can occur when the vocal content becomes quiet and then loud relative to other portions of the content (e.g., when a singer takes a breath and then sings loudly).

Figure 6:
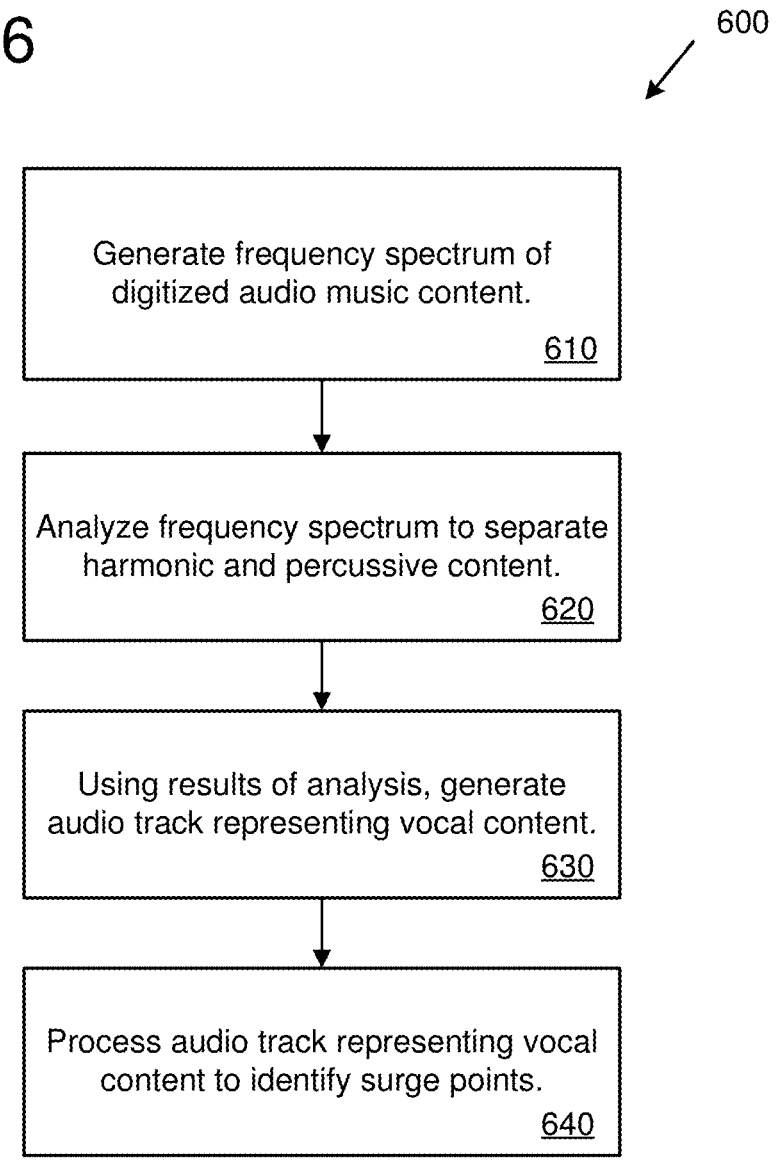
FIG. 6 is a diagram depicting an example method for identifying surge points within music content.

FIG. 6 is a flowchart of an example method 600 for identifying surge points within audio music content. At 610, a frequency spectrum is generated for at least a portion of digitized audio music content. For example, the music content can be a song or another type of music content. In some implementations, the frequency spectrum is generated by applying an STFT to the music content. In some implementations, the frequency spectrum is generated by applying a constant-Q transform to the music content. In some implementations, the frequency spectrum is represented as a spectrogram, or another type of two-dimensional representation the STFT.

At 620, the frequency spectrum is analyzed to separate the harmonic content and the percussive content. In some implementations, median filtering is used to perform the separation.

At 630, using results of the analysis of the frequency spectrum, an audio track is generated representing vocal content within the music content. For example, audio track can be generated as digital audio content stored in memory or on a storage device. In some implementations, the vocal content refers to a human voice (e.g., singing). In some implementations, the vocal content can be a human voice or audio content from another source (e.g., a real or electronic instrument, synthesizer, computer-generated sound, etc.) with audio characteristics similar to a human voice.

At 640, the audio track representing the vocal content is processed to identify surge points. A surge point indicates an interesting point within the music content. In some implementations, a surge point is the location within the music content where vocal power falls to a minima and then returns to a level higher than the vocal power was prior to the minima. In some implementations, various classifiers are considered in order to identify the surge point (or surge points), which can include various aspects of vocal power (e.g., raw vocal energy and/or vocal energy processed using various filters), spectral flux, and/or Foote novelty. In some implementations, the classifiers include a depth classifier (representing the difference in energy between the minima and its adjacent maxima, indicating how quiet the pause is relative to its surroundings), a width classifier (representing the width of the minima, indicating the length of the pause), a bar energy classifier (representing the total energy in the following bar, indicating how loud the following surge is), and a beat energy classifier (representing the total energy in the following beat, indicating how loud the first note of the following surge is). For example, a number of candidate surge points can be identified and the highest ranked candidate (based on one or more classifiers) can be selected as the surge point.

In some implementations obtaining the separate audio data with the vocal content involves a two-pass procedure. In a first pass, the frequency spectrum is generated using an STFT with a relatively low frequency resolution (e.g., by using a relatively small number of frequency bands, such as 4,096). Median filtering is then performed to separate the harmonic and percussive content where the vocal content is primarily included in the harmonic content due to the relatively low frequency resolution. In a second pass, the harmonic (plus vocal) content is processed using an STFT with a relatively high frequency resolution (compared with the resolution used in the first pass, which can be achieved using a relatively large number of frequency bands, such as 16,384), and median filtering is then performed on the resulting frequency spectrum to separate the vocal content from the harmonic (plus vocal) content.

An indication of the surge points can be output. For example, the location of a surge point can be output as a specific time location within the music content (e.g., identified by a time location within the music content).

Surge points can be used to select interesting portions of music content. For example, a portion (e.g., a clip) of the music content around the surge point (e.g., a number of seconds of content that encompasses the surge point) can be selected. The portion can be used to represent the music content (e.g., as a portion from which a person would easily recognize the music content or song). In some implementations, a collection of portions can be selected from a collection of songs.

Figure 7:
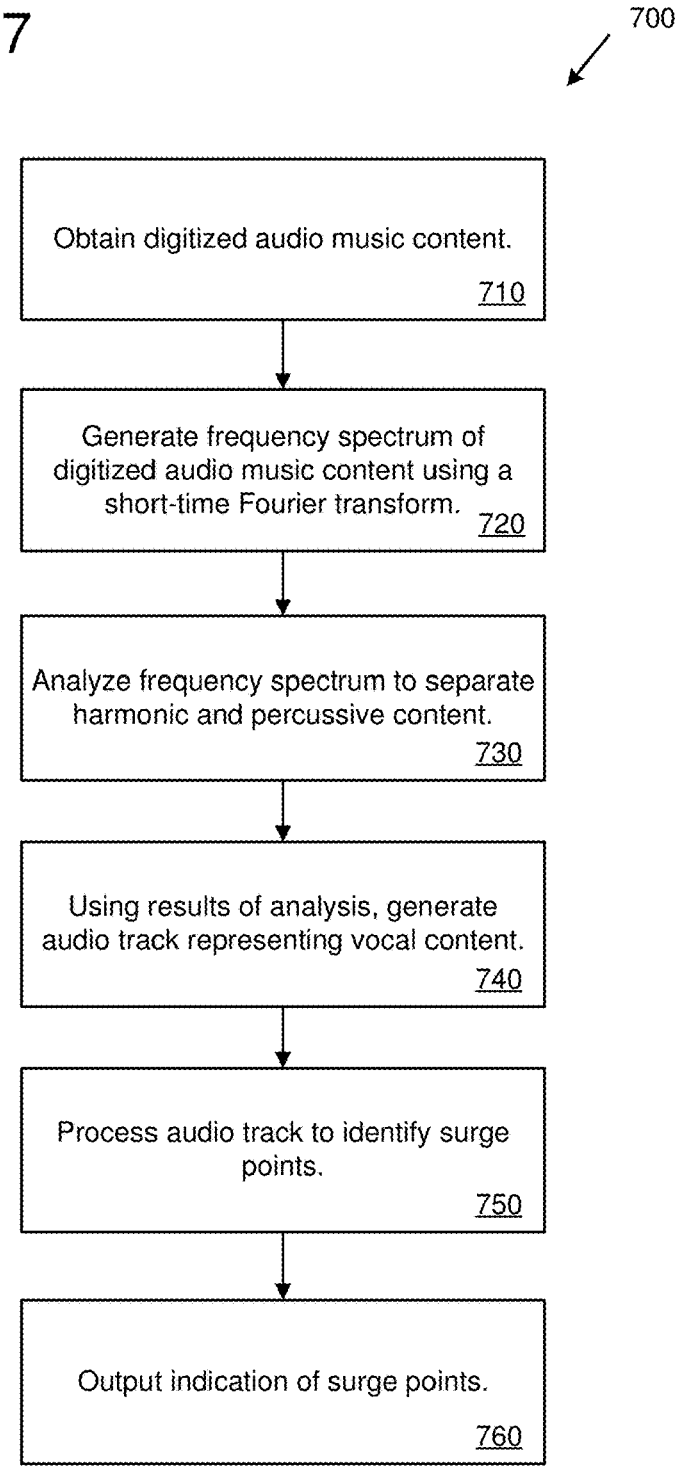
FIG. 7 is a diagram depicting an example method for identifying surge points within music content using short-time Fourier transforms.

FIG. 7 is a flowchart of an example method 700 for identifying surge points within audio music content using short-time Fourier transforms. At 710, digitized audio music content is obtained (e.g., from memory, from a local file, from a remote location, etc.).

At 720, a frequency spectrum is generated for at least a portion of digitized audio music content using an STFT. At 730, the frequency spectrum is analyzed to separate the harmonic content and the percussive content.

At 740, an audio track representing vocal content is generated using results of the analysis. In some implementations, the vocal content is included in the harmonic content and separated by applying an STFT to the harmonic content (e.g., at a higher frequency resolution than the first STFT performed at 720).

At 750, the audio track representing the vocal content is processed to identify surge points. In some implementations, a surge point is the location within the music content where vocal power falls to a minima and then returns to a level higher than the vocal power was prior to the minima. In some implementations, various classifiers are considered in order to identify the surge point (or surge points), which can include various aspects of vocal power (e.g., raw vocal energy and/or vocal energy processed using various filters), spectral flux, and/or Foote novelty.

At 760, an indication of the identified surge points is output. In some implementations, a single surge point is selected (e.g., the highest ranked candidate based on classifier scores). In some implementations, multiple surge points are selected (e.g., the highest ranked candidates).

Figure 8:
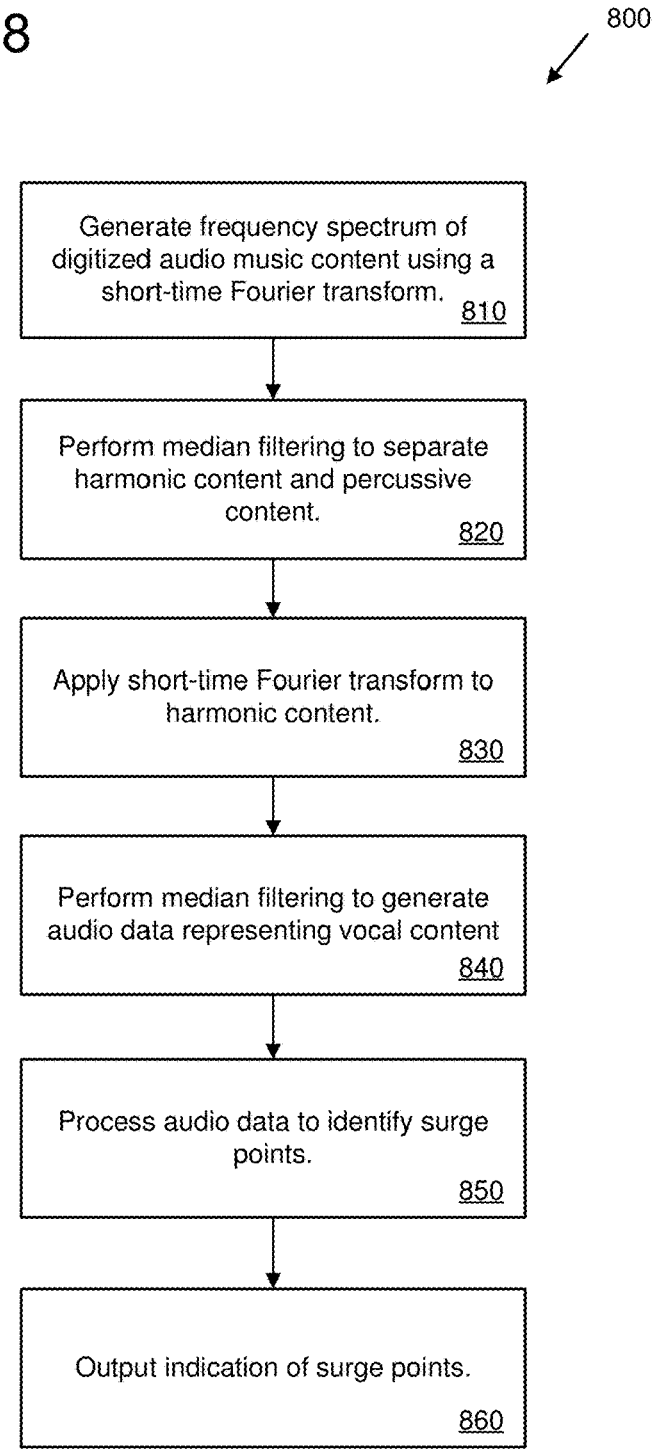
FIG. 8 is a diagram depicting an example method for identifying surge points within music content using short-time Fourier transforms and median filtering.

FIG. 8 is a flowchart of an example method 800 for identifying surge points within audio music content using short-time Fourier transforms and median filtering.

At 810, a frequency spectrum is generated for at least a portion of digitized audio music content using an STFT with a first frequency resolution. At 820, median filtering is performed on the frequency spectrum to separate harmonic content and percussive content. The first frequency resolution is selected so that vocal content will be included with the harmonic content when the median filtering is performed to separate the harmonic content and the percussive content.

At 830, an STFT with a second frequency resolution is applied to the harmonic content (which also contains the vocal content). The second frequency resolution is higher than the first frequency resolution. At 840, median filtering is performed to results of the STFT using the second frequency resolution to generate audio data representing the vocal content.

At 850, the audio data representing the vocal content is processed to identify one or more surge points. At 860 an indication of the identified surge points is output.

Computing Systems

Figure 9:
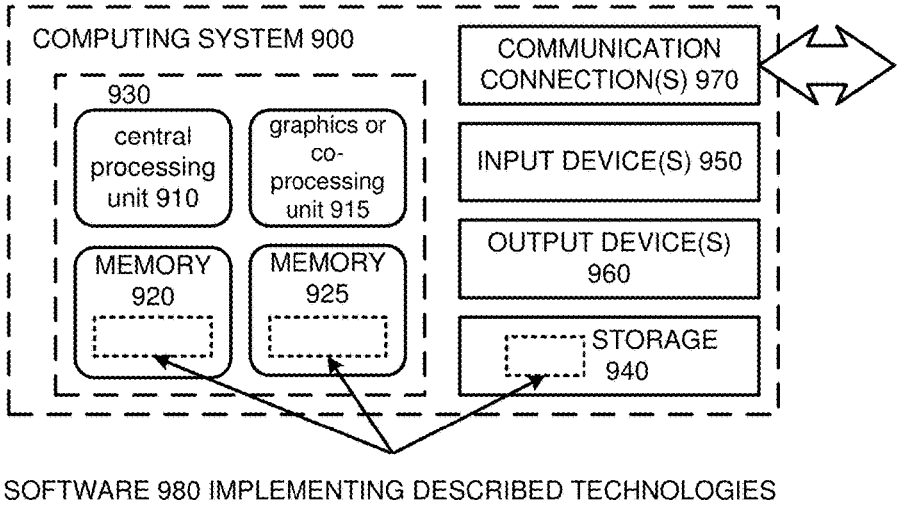
FIG. 9 is a diagram of an example computing system in which some described embodiments can be implemented.

FIG. 9 depicts a generalized example of a suitable computing system 900 in which the described innovations may be implemented. The computing system 900 is not intended to suggest any limitation as to scope of use or functionality, as the innovations may be implemented in diverse general-purpose or special-purpose computing systems.

With reference to FIG. 9, the computing system 900 includes one or more processing units 910, 915 and memory 920, 925. In FIG. 9, this basic configuration 930 is included within a dashed line. The processing units 910, 915 execute computer-executable instructions. A processing unit can be a general-purpose central processing unit (CPU), processor in an application-specific integrated circuit (ASIC), or any other type of processor. In a multi-processing system, multiple processing units execute computer-executable instructions to increase processing power. For example, FIG. 9 shows a central processing unit 910 as well as a graphics processing unit or co-processing unit 915. The tangible memory 920, 925 may be volatile memory (e.g., registers, cache, RAM), non-volatile memory (e.g., ROM, EEPROM, flash memory, etc.), or some combination of the two, accessible by the processing unit(s). The memory 920, 925 stores software 980 implementing one or more innovations described herein, in the form of computer-executable instructions suitable for execution by the processing unit(s).

A computing system may have additional features. For example, the computing system 900 includes storage 940, one or more input devices 950, one or more output devices 960, and one or more communication connections 970. An interconnection mechanism (not shown) such as a bus, controller, or network interconnects the components of the computing system 900. Typically, operating system software (not shown) provides an operating environment for other software executing in the computing system 900, and coordinates activities of the components of the computing system 900.

The tangible storage 940 may be removable or non-removable, and includes magnetic disks, magnetic tapes or cassettes, CD-ROMs, DVDs, or any other medium which can be used to store information and which can be accessed within the computing system 900. The storage 940 stores instructions for the software 980 implementing one or more innovations described herein.

The input device(s) 950 may be a touch input device such as a keyboard, mouse, pen, or trackball, a voice input device, a scanning device, or another device that provides input to the computing system 900. For video encoding, the input device(s) 950 may be a camera, video card, TV tuner card, or similar device that accepts video input in analog or digital form, or a CD-ROM or CD-RW that reads video samples into the computing system 900. The output device(s) 960 may be a display, printer, speaker, CD-writer, or another device that provides output from the computing system 900.

The communication connection(s) 970 enable communication over a communication medium to another computing entity. The communication medium conveys information such as computer-executable instructions, audio or video input or output, or other data in a modulated data signal. A modulated data signal is a signal that has one or more of its characteristics set or changed in such a manner as to encode information in the signal. By way of example, and not limitation, communication media can use an electrical, optical, RF, or other carrier.

The innovations can be described in the general context of computer-executable instructions, such as those included in program modules, being executed in a computing system on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing system.

The terms "system" and "device" are used interchangeably herein. Unless the context clearly indicates otherwise, neither term implies any limitation on a type of computing system or computing device. In general, a computing system or computing device can be local or distributed, and can include any combination of special-purpose hardware and/or general-purpose hardware with software implementing the functionality described herein.

For the sake of presentation, the detailed description uses terms like "determine" and "use" to describe computer operations in a computing system. These terms are high-level abstractions for operations performed by a computer, and should not be confused with acts performed by a human being. The actual computer operations corresponding to these terms vary depending on implementation.

Example Implementations

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods.

Any of the disclosed methods can be implemented as computer-executable instructions or a computer program product stored on one or more computer-readable storage media and executed on a computing device (e.g., any available computing device, including smart phones or other mobile devices that include computing hardware). Computer-readable storage media are tangible media that can be accessed within a computing environment (one or more optical media discs such as DVD or CD, volatile memory (such as DRAM or SRAM), or nonvolatile memory (such as flash memory or hard drives)). By way of example and with reference to FIG. 9, computer-readable storage media include memory 920 and 925, and storage 940. The term computer-readable storage media does not include signals and carrier waves. In addition, the term computer-readable storage media does not include communication connections, such as 970.

Any of the computer-executable instructions for implementing the disclosed techniques as well as any data created and used during implementation of the disclosed embodiments can be stored on one or more computer-readable storage media. The computer-executable instructions can be part of, for example, a dedicated software application or a software application that is accessed or downloaded via a web browser or other software application (such as a remote computing application). Such software can be executed, for example, on a single local computer (e.g., any suitable commercially available computer) or in a network environment (e.g., via the Internet, a wide-area network, a local-area network, a client-server network (such as a cloud computing network), or other such network) using one or more network computers.

For clarity, only certain selected aspects of the software-based implementations are described. Other details that are well known in the art are omitted. For example, it should be understood that the disclosed technology is not limited to any specific computer language or program. For instance, the disclosed technology can be implemented by software written in C++, Java, Perl, JavaScript, Adobe Flash, or any other suitable programming language. Likewise, the disclosed technology is not limited to any particular computer or type of hardware. Certain details of suitable computers and hardware are well known and need not be set forth in detail in this disclosure.

Furthermore, any of the software-based embodiments (comprising, for example, computer-executable instructions for causing a computer to perform any of the disclosed methods) can be uploaded, downloaded, or remotely accessed through a suitable communication means. Such suitable communication means include, for example, the Internet, the World Wide Web, an intranet, software applications, cable (including fiber optic cable), magnetic communications, electromagnetic communications (including RF, microwave, and infrared communications), electronic communications, or other such communication means.

The disclosed methods, apparatus, and systems should not be construed as limiting in any way. Instead, the present disclosure is directed toward all novel and nonobvious features and aspects of the various disclosed embodiments, alone and in various combinations and sub combinations with one another. The disclosed methods, apparatus, and systems are not limited to any specific aspect or feature or combination thereof, nor do the disclosed embodiments require that any one or more specific advantages be present or problems be solved.

The technologies from any example can be combined with the technologies described in any one or more of the other examples. In view of the many possible embodiments to which the principles of the disclosed technology may be applied, it should be recognized that the illustrated embodiments are examples of the disclosed technology and should not be taken as a limitation on the scope of the disclosed technology.

What is claimed is:

1. A method, implemented by a computing device, the method comprising:

obtaining audio music content in a digitized format;

generating a frequency spectrum of at least a portion of the music content;

analyzing the frequency spectrum to separate harmonic content and percussive content;

using results of the analysis, generating an audio track representing vocal content within the music content;

processing the audio track representing vocal content to identify at least one surge point within the music content; and outputting an indication of the at least one surge point.

2. The method of claim 1 wherein analyzing the frequency spectrum to separate harmonic content and percussive content comprises:

performing median filtering on the frequency spectrum to separate the harmonic content and the percussive content.

3. The method of claim 1 wherein analyzing the frequency spectrum to separate harmonic content and percussive content comprises:

in a first pass:

generating the frequency spectrum using a short-time Fourier transform (STFT) with a first frequency resolution; and performing median filtering on the frequency spectrum to separate the harmonic content and the percussive content; and in a second pass:

applying an STFT with a second frequency resolution to the harmonic content produced in the first pass; and performing median filtering to results of the STFT using the second frequency resolution to generating the audio track representing vocal content;

wherein the second frequency resolution is higher than the first frequency resolution.

4. The method of claim 1 wherein processing the audio track representing vocal content to identify at least one surge point within the music content comprises:

applying a low-pass filter to the audio track that removes features that are less than the length of a bar; and identifying the at least one surge point based, at least in part, upon the low-pass filtered audio track.

5. The method of claim 1 wherein the at least one surge point is a location within the music content where vocal power falls to a local minimum and then returns to a level higher than the vocal power was prior to the local minimum.

6. The method of claim 1 wherein generating the frequency spectrum comprises:

applying a short-time Fourier transform (STFT) to the at least a portion of the music content.

7. The method of claim 1 wherein generating the frequency spectrum comprises:

applying a constant-Q transform to the at least a portion of the music content.

8. The method of claim 1 wherein processing the audio track representing vocal content to identify at least one surge point comprises:

filtering the audio track using a low-pass filter or a band-pass filter;

applying one or more of a depth classifier, a width classifier, a bar energy classifier, or a beat energy classifier to the filtered audio track; and using result of the one or more classifiers to identify the at least one surge point.

9. A computing device comprising:

a processing unit; and memory;

the computing device configured to perform operations comprising:

obtaining audio music content in a digitized format;

generating a frequency spectrum of at least a portion of the music content;

analyzing the frequency spectrum to separate harmonic content and percussive content;

using results of the analysis, generating an audio track representing vocal content within the music content; and processing the audio track representing vocal content to identify at least one surge point within the music content.

10. The computing device of claim 9 wherein analyzing the frequency spectrum to separate harmonic content and percussive content comprises:

performing median filtering on the frequency spectrum to separate the harmonic content and the percussive content.

11. The computing device of claim 9 wherein processing the audio track representing vocal content to identify at least one surge point within the music content comprises:

applying a low-pass filter to the audio track that removes features that are less than the length of a bar; and identifying the at least one surge point based, at least in part, upon the low-pass filtered audio track.

12. The computing device of claim 9 wherein the at least one surge point is a location within the music content where vocal power falls to a local minimum and then returns to a level higher than the vocal power was prior to the local minimum.

13. The computing device of claim 9 wherein generating the frequency spectrum comprises:

applying a short-time Fourier transform (STFT) to the at least a portion of the music content.

14. The computing device of claim 9 wherein generating the frequency spectrum comprises:

applying a constant-Q transform to the at least a portion of the music content.

15. The computing device of claim 9 wherein processing the audio track representing vocal content to identify at least one surge point comprises:

filtering the audio track using a low-pass filter or a band-pass filter;

applying one or more of a depth classifier, a width classifier, a bar energy classifier, or a beat energy classifier to the filtered audio track; and using result of the one or more classifiers to identify the at least one surge point.

16. A computer-readable storage medium storing computer-executable instructions for causing a computing device to perform operations, the operations comprising:

obtaining audio music content in a digitized format;

generating a frequency spectrum of at least a portion of the music content;

analyzing the frequency spectrum to separate harmonic content and percussive content;

using results of the analysis, generating an audio track representing vocal content within the music content; and processing the audio track representing vocal content to identify at least one surge point within the music content.

17. The computer-readable storage medium of claim 16 wherein analyzing the frequency spectrum to separate harmonic content and percussive content comprises:

performing median filtering on the frequency spectrum to separate the harmonic content and the percussive content.

18. The computer-readable storage medium of claim 16 wherein processing the audio track representing vocal content to identify at least one surge point within the music content comprises:

applying a low-pass filter to the audio track that removes features that are less than the length of a bar; and identifying the at least one surge point based, at least in part, upon the low-pass filtered audio track.

19. The computer-readable storage medium of claim 16 wherein generating the frequency spectrum comprises:

applying a short-time Fourier transform (STFT) to the at least a portion of the music content.

20. The computer-readable storage medium of claim 16 wherein generating the frequency spectrum comprises:

applying a constant-Q transform to the at least a portion of the music content.

* * * * *